US009705212B1

(12) United States Patent
Wu

(10) Patent No.: US 9,705,212 B1
(45) Date of Patent: Jul. 11, 2017

(54) STRUCTURE IMPROVEMENT FOR CONNECTION TERMINALS OF TERMINAL BLOCK

(71) Applicant: DINKLE ENTERPRISE CO., LTD., New Taipei (TW)

(72) Inventor: Shang-Tsai Wu, New Taipei (TW)

(73) Assignee: DINKLE ENTERPRISE CO., LTD., New Taipei (TW)

( * ) Notice: Subject to any disclaimer, the term of this patent is extended or adjusted under 35 U.S.C. 154(b) by 0 days.

(21) Appl. No.: 15/286,203

(22) Filed: Oct. 5, 2016

(51) Int. Cl.
*H01R 9/16* (2006.01)

(52) U.S. Cl.
CPC ..... *H01R 9/16* (2013.01)

(58) Field of Classification Search
CPC ..... H01R 4/4818–4/4845
USPC ..... 439/441, 440
See application file for complete search history.

(56) References Cited

U.S. PATENT DOCUMENTS 5,975,940 A * 11/1999 Hartmann ..... H01R 4/4818 439/441
7,238,043 B2 * 7/2007 Reibke ..... H01R 4/4827 439/441
7,686,626 B2 * 3/2010 Wu ..... H01R 4/64 439/95
7,686,627 B2 * 3/2010 Wu ..... H01R 9/2691 439/95
7,815,463 B2 * 10/2010 Gerberding ..... H01R 9/2483 439/441
7,896,686 B2 * 3/2011 Hoppe ..... H01R 4/4827 439/441
2006/0063419 A1 * 3/2006 Steinkemper ..... H01R 4/4827 439/441
2006/0063420 A1 * 3/2006 Reibke ..... H01R 4/4827 439/441
2007/0072481 A1 * 3/2007 Edenharter ..... H01R 4/4818 439/441

(Continued)

FOREIGN PATENT DOCUMENTS

DE 20312861 U1 10/2003
EP 1515397 A1 3/2005

(Continued)

OTHER PUBLICATIONS

Search Report dated Dec. 22, 2016 of the corresponding European patent application.

*Primary Examiner* — Gary Paumen
(74) *Attorney, Agent, or Firm* — Chun-Ming Shih; HDLS IPR Services

(57) ABSTRACT

A structure improvement for connection terminals of a terminal block includes a frame body (1) and an elastic part (2). The frame body (1) has a bottom plate (10) and a standing plate (11) bending and extending from a side of the bottom plate (10). The standing plate (11) further extends to form a resisting portion (110) and a first frame (111) curved opposite to the resisting portion (110). The elastic part (2) has a contact portion (20), a hook portion (210) extending from the contact portion (20), and a second frame (22) curved opposite to the hook portion (210). The resisting portion (110) passes through and is against the second frame (22). The hook portion (210) passes through and hooks on the first frame (111). The contact portion (20) is disposed toward the resisting portion (110) from a side of the first frame (111).

10 Claims, 5 Drawing Sheets

(56) References Cited

U.S. PATENT DOCUMENTS

2010/0081316 A1* 4/2010 Eppe ..... H01H 1/5844
439/441

FOREIGN PATENT DOCUMENTS

| | | | |
|---|---|---|---|
| EP | 1956684 | A2 | 8/2008 |
| TW | 201407885 | A | 2/2014 |
| WO | 2015140148 | A1 | 9/2015 |

* cited by examiner

STRUCTURE IMPROVEMENT FOR CONNECTION TERMINALS OF TERMINAL BLOCK

BACKGROUND OF THE INVENTION

Field of the Invention

The present invention relates to an electrical connector and in particular to a structure improvement for connection terminals of a terminal block.

Description of Prior Art

A terminal block is an electronic component widely applied to various machines and tools which need electrical connection. The terminal block can be used for the connection with a power cable and a control cable, or used for data transmission line.

However, the terminal in the traditional terminal block is formed by a mutual combination of a body and an elastic plate; the mutual combination is achieved by riveting or snap-in latch. Due to the terminals suffering from the repeated use of connection, the combination effect between the body and the elastic plate is likely to be damaged or the connection could be separated due to insufficient strength of snap-in latch structure. Consequently, the terminals will lose the original functions easily.

In view of this, the inventor pays special attention to research with the application of related theory and tries to improve and overcome the above disadvantages regarding the above related art, which becomes the improvement target of the inventor.

SUMMARY OF THE INVENTION

The main objective of the present invention is to provide a structure improvement for connection terminals of a terminal block, which can achieve a good combination effect by mutual hooking or mutual resisting between the components.

To achieve the above objective, the present invention provides a structure improvement for connection terminals of a terminal block, which comprises a frame body and at least one elastic part. The frame body has a bottom plate and at least one standing plate bending and extending from a side of the bottom plate. The standing plate further extends to form a resisting portion and a first frame curved opposite to the resisting portion. The elastic part has a contact portion, a hook portion further extending from the contact portion, and a second frame curved opposite to the hook portion. The resisting portion passes through the second frame to resist in the second frame. The hook portion passes through the first frame to hook on the first frame. The contact portion is disposed and moved from a side of the first frame to the resisting portion. Thus, a good combination effect can be achieved by means of mutual hooking and mutual resisting between the frame body and the elastic part.

DETAILED DESCRIPTION OF THE INVENTION

To understand the technical features and details of the present invention, please refer to the following detailed description and accompanying figures. However, the accompanying figures are only for reference and explanation, but not to limit the scope of the present invention.

Figure 1:
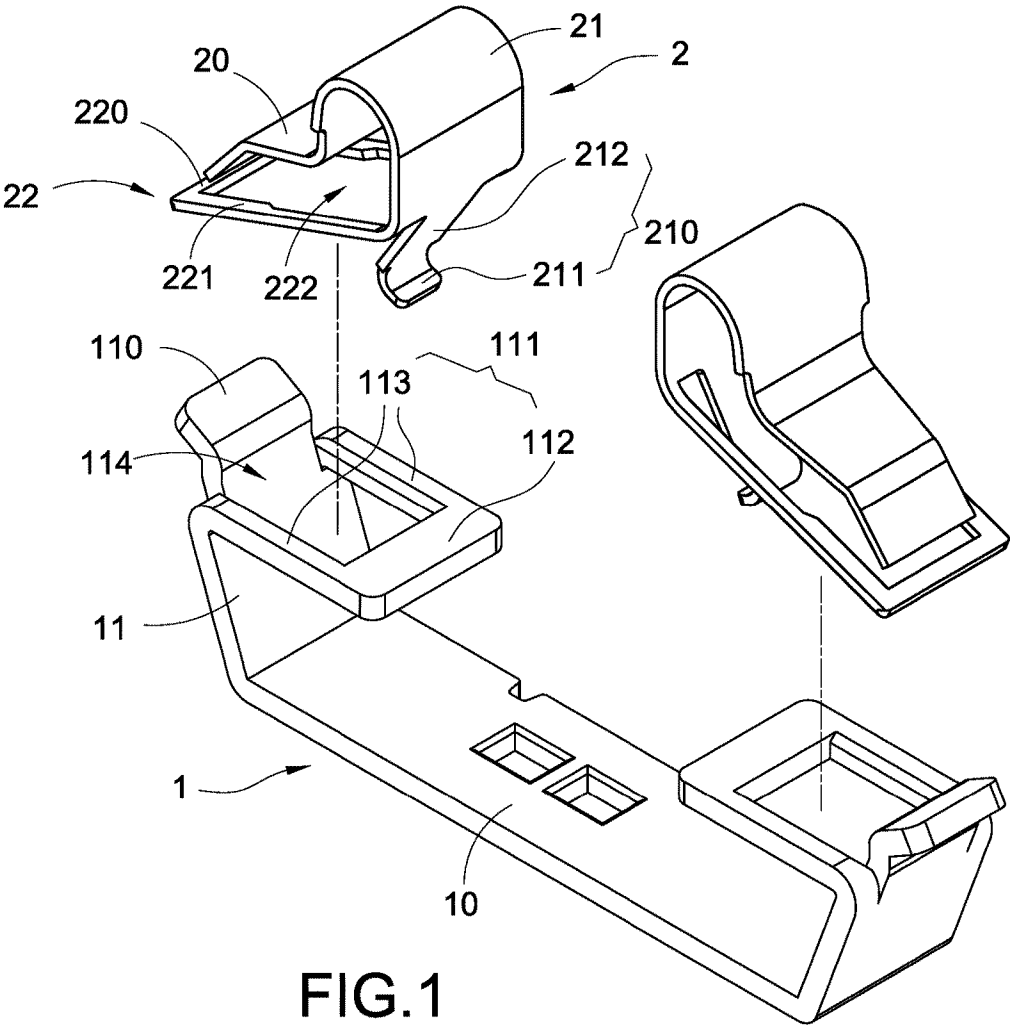
FIG. 1 is a perspective exploded view of the first embodiment of the present invention.
Figure 2:
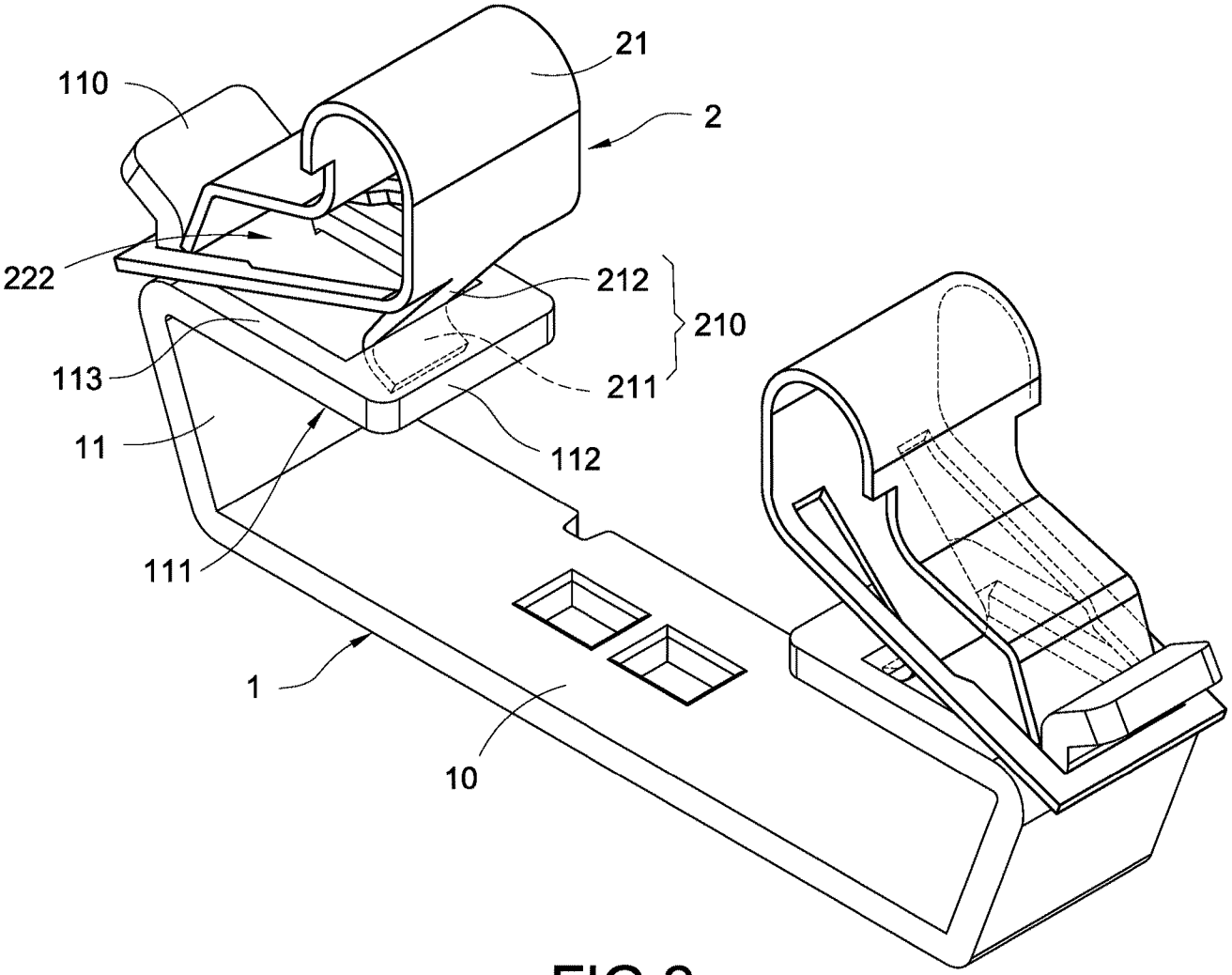
FIG. 2 is a perspective assembled view of the first embodiment of the present invention.
Figure 3:
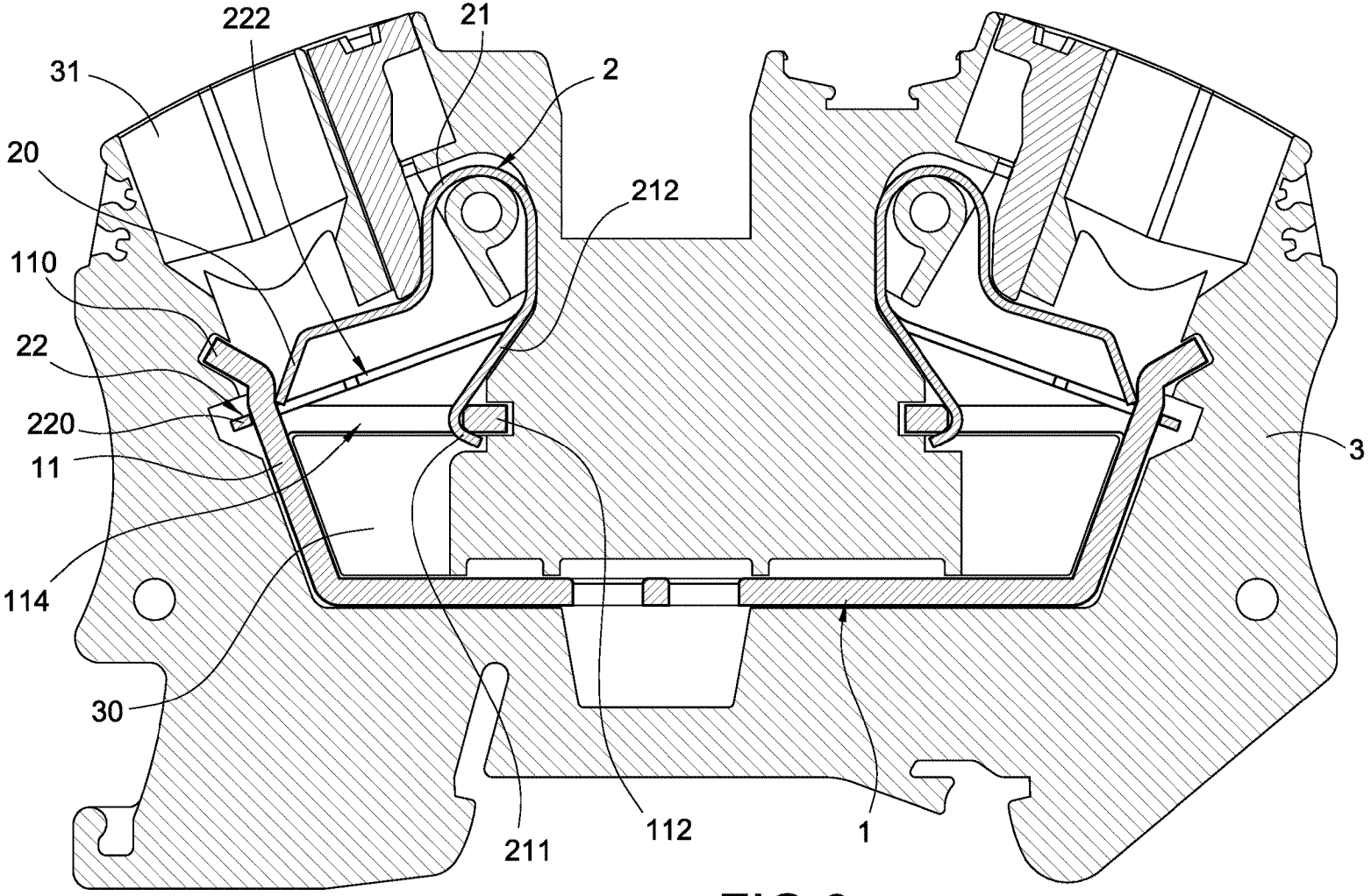
FIG. 3 is a cross-sectional view of the connection terminal disposed in the terminal block in operation according to the first embodiment of the present invention.

Please refer to FIGS. 1, 2, and 3, which are the perspective exploded view of the first embodiment of the present invention, the perspective assembled view of the first embodiment of the present invention, and the cross-sectional view of the connection terminal disposed in the terminal block in operation according to the first embodiment of the present invention, respectively. The present invention provides a structure improvement for connection terminals of a terminal block, which is disposed in the terminal block 3. The terminal block 3 is provided with a hollow terminal slot 30 therein and a plug hole 31 therein communicating with the terminal slot 30 for the insertion of the connecting wire (not shown) such that after the connection terminals of the terminal block are disposed in the terminal slot 30, an electrical connection of the connection wire can be provided by inserting the connection wire into the plug hole 31. The connection terminals of the terminal block comprise a frame body 1 and at least one elastic part 2.

The frame body 1 has a bottom plate 10 and at least one standing plate 11 bending and extending from a side of the bottom plate 10. In the current embodiment of the present invention, the frame body 1 has two standing plates 11 which are individually disposed at two sides of the bottom plate 10 to bend and extend; the two sides of the bottom plate 10 are opposite to and separate from each other. Each of the two standing plates 11 further extends to form a resisting portion 110 and a first frame 111 curved opposite to the resisting portion 110. The resisting portion 110 can bend toward outside of the standing plate 11. The first frame 111 can be shaped like a letter of "U" or "L" and comprises a first primary frame edge 112 and at least one first secondary frame edge 113 which extends from the standing plate 11 and connects to the first primary frame edge 112 such that a first opening 114 is formed in the first frame 111.

The elastic part 2 is combined between the resisting portion 110 and the first frame 111; the number of the elastic parts 2 can be increased corresponding to that of the standing plates 11. That is, each of standing plates 11 corresponds to an elastic part 2. Each of standing plates 11 has a contact portion 20, a hook portion 210 further extending from the contact portion 20, and a second frame 22 curved opposite to the hook portion 210. The second frame 22 and the contact portion 20 extend in the same direction. In an embodiment of the present invention, the contact portion 20 forms a curved portion 21 which is integrally connected to the hook portion 210 and the second frame 22. The hook portion 210 further can consist of a hook end 211 and an elastic arm 212 and be connected to the contact portion 20 or the curved portion 21 through the elastic arm 212. The second frame 22 can be also shaped like a letter of "U" or "L" and comprises a second primary frame edge 220 and at least one second secondary frame edge 221 which extends from the contact portion 20 or the curved portion 21 to connect to the second primary frame edge 220 such that a second opening 222 is formed in the second frame 22.

During the assembly, the contact portion 20 of the elastic part 2 has to be disposed toward the resisting portion 110 from a side of the first frame 111. After the resisting portion 110 of the frame body 1 passes through the second opening 222 in the second frame 22 of the elastic part 2 such that the resisting portion 110 resists in the second frame 22, the hook portion 210 of the elastic part 2 passes through the first opening 114 of the first frame 111 such that the hook portion 210 hooks on the first frame 111. In this way, a good combination effect can be achieved by means of the mutual hooking and mutual resisting.

Thus, by means of the above structure, the structure improvement for connection terminals of a terminal block of the present invention is obtained.

Figure 4:
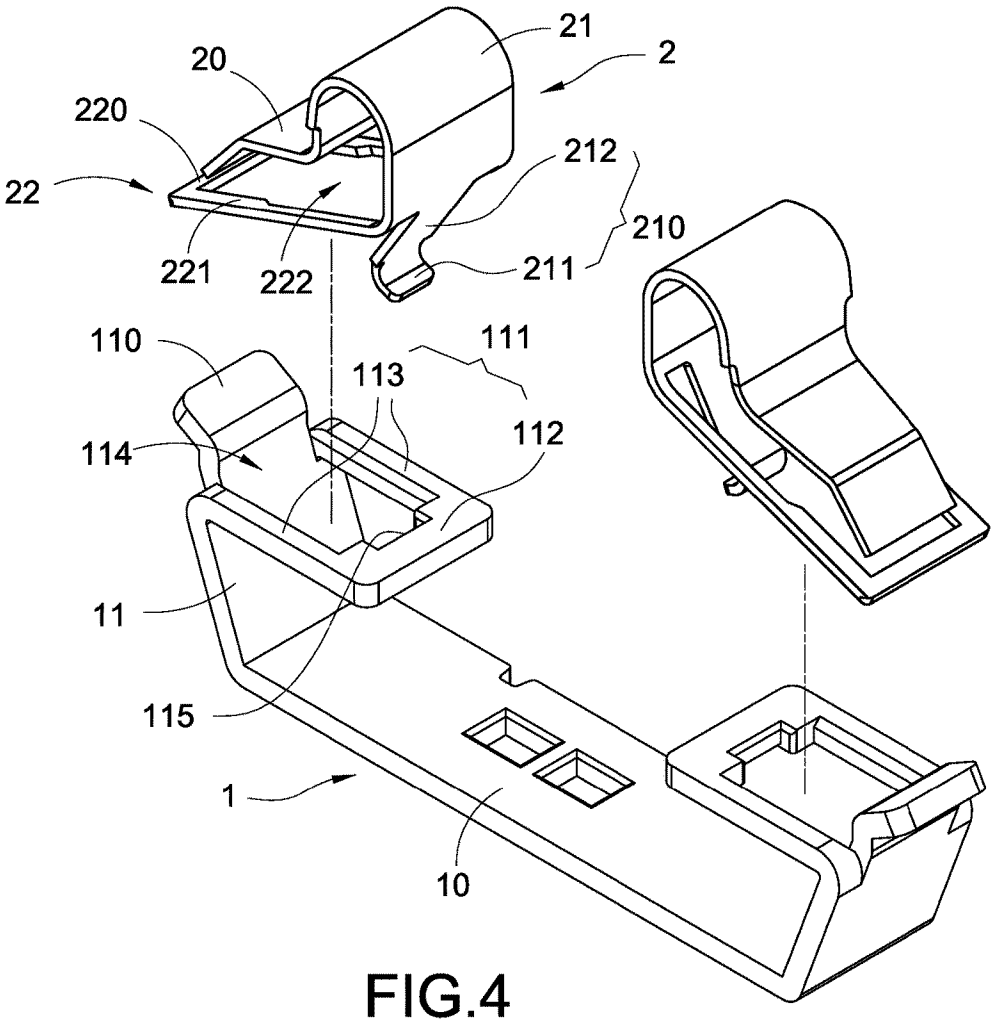
FIG. 4 is a perspective exploded view of the second embodiment of the present invention.

Moreover, please refer to FIG. 4, which is a perspective exploded view of the second embodiment of the present invention. To make the hook portion 210 of the elastic part 2 hook on the first frame 111 more firmly, a slit 115 can be recessed at the inner edge of the first primary frame edge 112 of the first frame 111 to match with and fix the hook end 211 of the hook portion 210.

Figure 6:
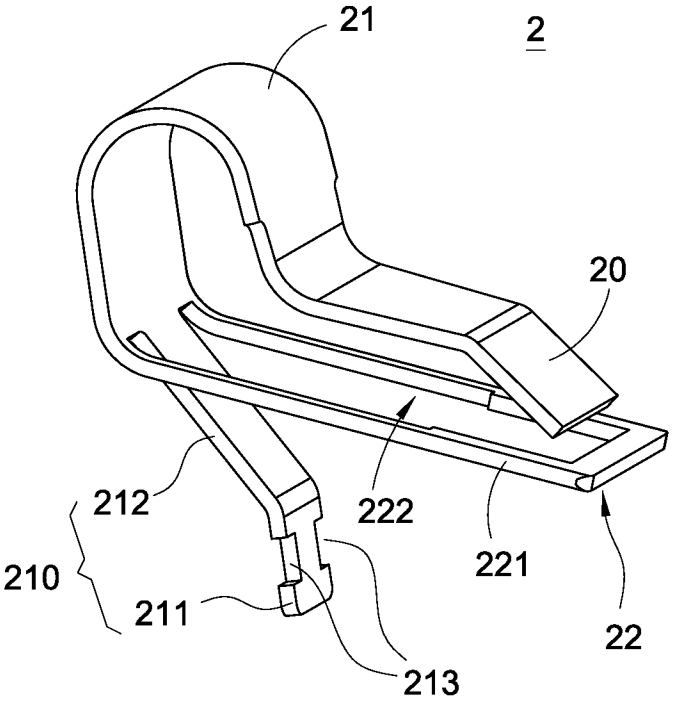
FIG. 6 is a perspective view of the elastic part according to the fourth embodiment of the present invention.
Figure 5:
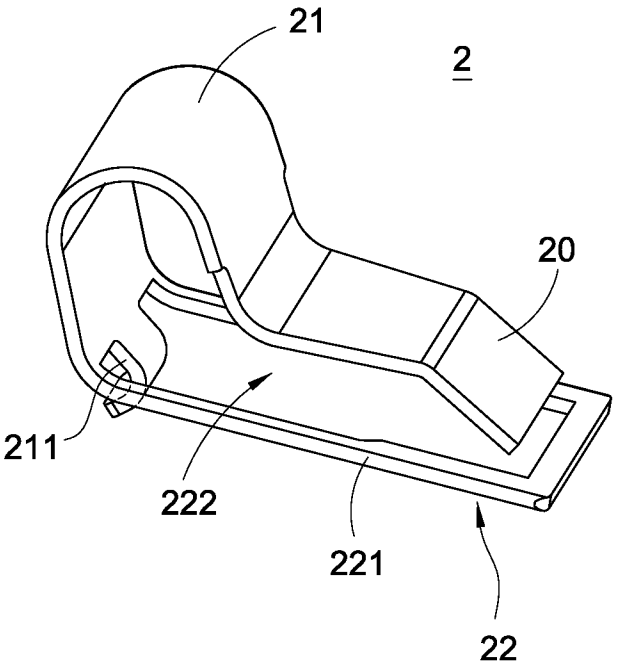
FIG. 5 is a perspective view of the elastic part according to the third embodiment of the present invention.

In addition, please refer to FIGS. 5 and 6, which are the perspective views of the elastic part according to the third and the fourth embodiments of the present invention, respectively. The length of the elastic arm 212 of the hook portion 210 can be zeroed, decreased (shown in FIG. 5), or increased (shown in FIG. 6) depending on the configuration between the elastic part 2 and the frame body 1. Also, as shown in FIG. 6, two slots 213 can be individually disposed at two sides of the hook end 211 of the hook portion 210 to match with and further lock the slit 115.

In summary, the present invention indeed achieves the expected objective and can overcome the disadvantages of the prior art. Also, it is novel, useful, and non-obvious to be patentable. Please examine the application carefully and grant it as a formal patent for protecting the rights of the inventor.

The embodiments described above are only preferred ones of the present invention and are not to limit the scope of the present invention. All the equivalent modifications and variations applying the specification and figures of the present invention should be embraced by the claimed scope of the present invention.

What is claimed is:

1. A structure improvement for connection terminals of a terminal block, comprising:

a frame body (1) having a bottom plate (10) and at least one standing plate (11) bending and extending from a side of the bottom plate (10), wherein the standing plate (11) further extends to form a resisting portion (110) and a first frame (111) curved opposite to the resisting portion (110); and at least one elastic part (2) having a contact portion (20), a hook portion (210) further extending from the contact portion (20), and a second frame (22) curved opposite to the hook portion (210), wherein the resisting portion (110) passes through the second frame (22) to be against the second frame (22), wherein the hook portion (210) passes through the first frame (111) to hook on the first frame (111), wherein the contact portion (20) is disposed toward the resisting portion (110) from a side of the first frame (111).

2. The structure improvement for connection terminals of a terminal block according to claim 1, wherein the frame body (1) has two standing plates (11) which are individually disposed at two sides of the bottom plate (10) to bend and extend, wherein the two sides of the bottom plate (10) are opposite to and separate from each other, wherein each of the two standing plates (11) corresponds to the elastic part (2).

3. The structure improvement for connection terminals of a terminal block according to claim 1, wherein the resisting portion (110) bends toward outside of the standing plate (11).

4. The structure improvement for connection terminals of a terminal block according to claim 1, wherein the first frame (111) is shaped like a letter of "U" or "L" and comprises a first primary frame edge (112) and at least one first secondary frame edge (113) which extends from the standing plate (11) and connects to the first primary frame edge (112) such that a first opening (114) is formed in the first frame (111).

5. The structure improvement for connection terminals of a terminal block according to claim 4, wherein a slit (115) is recessed at an inner edge of the first primary frame edge (112) to match with the hook portion (210).

6. The structure improvement for connection terminals of a terminal block according to claim 5, wherein two slots (213) are individually disposed at two sides of the hook portion (210) to match with the slit (115).

7. The structure improvement for connection terminals of a terminal block according to claim 1, wherein the contact portion (20) forms a curved portion (21) which is integrally connected to the hook portion (210) and the second frame (22).

8. The structure improvement for connection terminals of a terminal block according to claim 1, wherein the hook portion (210) consists of a hook end (211) and an elastic arm (212) and is connected to the contact portion (20) through the elastic arm (212).

9. The structure improvement for connection terminals of a terminal block according to claim 1, wherein the second frame (22) is shaped like a letter of "U" or "L" and comprises a second primary frame edge (220) and at least one second secondary frame edge (221) which extends from the contact portion (20) and connects to the second primary frame edge (220) such that a second opening (222) is formed in the second frame (22).

10. The structure improvement for connection terminals of a terminal block according to claim 1, wherein the second frame (22) and the contact portion (20) extend in the same direction.

* * * * *